United States Patent [19]

Nakayama et al.

[11] Patent Number: 5,057,389

[45] Date of Patent: Oct. 15, 1991

[54] ELECTROPHOTOGRAPHIC LITHOGRAPHIC PRINTING PLATE PRECURSOR WITH OVER BACK LAYER

[75] Inventors: Takao Nakayama; Chikashi Ohishi; Chiaki Kawamoto; Hidefumi Sera; Sho Nakao, all of Shizuoka, Japan

[73] Assignee: Fuji Photo Film Co., Ltd., Kanagawa, Japan

[21] Appl. No.: 371,784

[22] Filed: Jun. 27, 1989

[30] Foreign Application Priority Data

Jun. 27, 1988 [JP] Japan ..... 63-156927
Sep. 14, 1988 [JP] Japan ..... 63-228378

[51] Int. Cl.[5] ..... G03G 5/14; G03G 5/147

[52] U.S. Cl. ..... 430/49; 430/56; 430/60; 430/63; 430/103

[58] Field of Search ..... 430/49, 56, 60, 63, 430/103

[56] References Cited

U.S. PATENT DOCUMENTS 4,322,488 3/1982 Kuehnle et al. ..... 430/103
4,427,754 1/1984 Uchida et al. ..... 430/56
4,522,906 6/1985 Asao et al. ..... 430/63 X
4,555,461 11/1985 Shiba et al. ..... 430/49

FOREIGN PATENT DOCUMENTS 62-258460 11/1987 Japan ..... 430/56

*Primary Examiner*—Roland Martin
*Attorney, Agent, or Firm*—Sughrue, Mion, Zinn, Macpeak & Seas

[57] ABSTRACT

An electrophotographic lithographic printing plate precursor which is suitable for not only the ordinary developing methods but also the developing methods of direct electron injection system and which after developing, can readily be wound and fixed, as a lithographic printing plate, around a drum of a printing machine without any slippage after winding is provided. This precursor comprise a base of paper coated, on both surfaces thereof, with α-polyolefin laminated layers each having a volume resistivity of at most $1\times10^{10}\Omega$ and being further provided, on one side thereof, with a photoconductive layer and on the other side thereof, with an over back layer having a surface resistivity of at most $1\times10^{10}\Omega$ and a larger friction coefficient than the α-polyolefin laminated layer.

26 Claims, 3 Drawing Sheets

ELECTROPHOTOGRAPHIC LITHOGRAPHIC PRINTING PLATE PRECURSOR WITH OVER BACK LAYER

BACKGROUND OF THE INVENTION

1. Field of the Invention

This invention relates to an electrophotographic lithographic printing plate precursor and a developing method of the same and more particularly, it is concerned with an electrophotographic lithographic printing plate precursor which is suitable for not only the ordinary developing methods but also the developing methods of direct electron injection system and which after developing, can readily be wound and fixed, as a lithographic printing plate, around a drum of a printing machine without any slippage or slide after winding, and a developing method of the same.

2. Description of the Prior Art

Up to the present time, there has generally been employed an electrophotographic process for the production of a lithographic printing plate precursor comprising subjecting the photoconductive layer of an electrophotographic lithographic printing plate precursor (which will hereinafter be referred to as "master") to uniform static charge, to imagewise exposure and then to liquid development to obtain a toner image, then fixing this toner image and processing with an oil-desensitizing solution (etching solution) to render hydrophilic a non-image area free from the toner image.

As the base of the above described master, paper has hitherto been used, but this paper base tends to be penetrated with water, resulting in bad influences upon the printability and photographic properties. That is, the paper base is penetrated with the above described etching solution or dampening water during printing and expanded so that the photoconductive layer sometimes separates from the paper base to lower the printing durability, and the moisture content of the paper base is varied with the temperature and humidity conditions in carrying out the above described static charge or imagewise exposure so that the electric conductivity is varied to affect unfavorably the photographic performances.

In order to solve these problems, it has been proposed to coat the one or both surfaces of a paper base with, for example, an epoxy resin or ethylene-acrylic acid copolymer having water resisting property (Japanese Pat. Laid-Open Publication Nos. 138904/1975, 105580/1980 and 68753/1984) or to provide with a laminated layer of polyethylene or the like (Japanese Patent Laid-Open Publication Nos. 57994/1983 and 64395/1984).

On the other hand, the above described liquid development has generally been carried out by allowing a developing liquid DL to flow between electrodes 10 and 11 and a master P to pass through the developing liquid DL, as shown in FIG. 3.

In this developing system, however, movement of negative ions in the developing liquid (negative ions of a polymer added so as to control the charge (+) of a toner in the developing liquid DL, i.e. charge controlling agent) is slow and accordingly, the speed of the negative ions adhering to the surface of a substrate P2 to neutralize positive charges thereof is also slow, so that the adhesion speed of the toner (+) to the surface of a negatively charged photoconductive layer P1 be slow and the master is sometimes conveyed to a next step with toner-nonadhered area left.

In the case of an image which needs adhesion of a toner to a large area such as picture or pattern, in particular, the master is often conveyed to a next step while uniform formation of a so called solid image is not carried out, since when the master P is passing through the developing step, the toner adheres to only a part of the photoconductive layer P1 opposite to a part of the substrate P2 neutralized by adhesion of negative ions and does not adhere to all over the above described large area.

In this developing system, furthermore, the toner (+) gradually adheres to the electrode (−) 11 facing the substrate P2 to lower the developing performance and consequently, it is required to periodically clean the electrode 11.

In order to further solve the above described problems, the inventors have proposed a liquid developing method of direct electron injection system in which development is carried out by using an elastic conductor 12 such as hardened steel with a diameter of about 0.1 mm as shown in FIG. 2 instead of the above described electrode 11 of the prior art, contacting the conductor 12 with a substrate P2 of a master P, optionally changing a switch S, applying a voltage to between the conductor 12 and an electrode 10 from an external power source and directly feeding electrons from the conductor 12 to the substrate P2 (Japanese Patent Application No. 89373/1988).

According to this direct electron injection system, positive charges on the surface of the substrate P2 are rapidly and surely neutralized with the electrons directly fed from the conductor 12, so that adhesion of toners (+) to the surface of a photoconductive layer P1 can rapidly and surely be carried out and formation of a so-called solid part can uniformly and finely be carried out. In addition, other processings are not required than flowing of a developing liquid DL between the photoconductive layer P1 and electrode 10 and accordingly, the toners (+) do not adhere to the conductor 12.

In the case of the above described direct electron injection system, however, if the substrate P2 has a high electric resistance, electrons cannot directly be fed from the conductor 12 and therefore, it is necessary that the substrate 12 has some electric conductivity.

Of course, in the developing system of the prior art as shown in FIG. 3, if the electric conductivity of the substrate P2 is high to some extent, the neutralization speed of negative ions in the developing liquid DL and positive charges on the surface of the substrate P2 is somewhat increased. Therefore, it is of important significance to decrease the resistance of the substrate P2 in the field of liquid development and this is adapted to not only the above described direct electron injection system but also the prior art developing system. Furthermore, for the purpose of, during imagewise exposure, neutralizing negative charges on an exposed area of the photoconductive layer P1 with positive charges on the surface of the substrate P2 through the interior of the substrate P2, it is important that the substrate P2 has a low electric resistance.

In order to decrease the electric resistance of the substrate P2, it is necessary to decrease the resistance of a paper base itself for composing the substrate P2 by adding thereto an electrically conductive material or to decrease the resistance of a laminated layer such as of polyethylene provided on one or both surfaces of a paper base to lower the permeability of water as described above by adding a electrically conductive material to the laminated layer.

However, since the surface of the laminated layer formed by a lamination method, i.e. the surface of a non-photoconductive layer side of a substrate, which will hereinafter be referred to as "the surface of a substrate", has a very high smoothness, slide occurs between the surface of the substrate and that of a drum when a master, as lithographic printing plate after developing, is wound and fixed around the drum of a printing machine and thus it is very difficult to fix the above described printing plate to a correct position of the drum. During printing, moreover, the printing plate tends to suffer a further slide from the fixed position. If such a slide occurs, printing on a predetermined position of a printing paper is impossible and in the case of a so-called solid part such as pictures or patterns, there occur non-inking areas and uniform printing of the solid part is impossible.

In addition, it is not only difficult to wind a master round a feeding drum of a so-called electrophotographic plate making machine for subjecting the master to static charge, exposure and development and to deliver the master from the drum, but also it is feared that the master tends to suffer a slide from a predetermined running position during running the zones of static charge, exposure and development.

SUMMARY OF THE INVENTION

It is an object of the present invention to provide a master by employing a lamination method capable of obtaining the above described low electric resistance, whereby the above described disadvantages as to the surface of a substrate can be overcome.

It is another object of the present invention to provide an electrophotographic lithographic printing plate precursor or master having a substrate property capable of effecting well development by the direct electron injection system.

It is a further object of the present invention to provide a method of developing by the direct electron injection system using this master.

These objects can be attained by an electrophotographic lithographic printing plate precursor comprising a base of paper coated, on both surfaces thereof, with α-polyolefin laminated layers, each layer having a volume resistance of at most $1\times10^{10}\ \Omega$ and being provided, on one side thereof, with a photoconductive layer and on the other side thereof, with an over back layer having a surface resistivity of at most $1\times10^{10}$ 106 and a larger friction resistance than the α-polyolefin laminated layer, and a method of developing the electrophotographic lithographic printing plate precursor comprising arranging an electrode to face the photoconductive layer, supplying a developing liquid to between the electrode and photoconductive layer, contacting a conductor with the over back layer, optionally applying a voltage between the conductor and electrode and thereby carrying out liquid development.

BRIEF DESCRIPTION OF THE DRAWINGS

The accompanying drawings are to illustrate in detail the principle and merits of the present invention.

DETAILED DESCRIPTION OF THE PRESENT INVENTION

Figure 1:
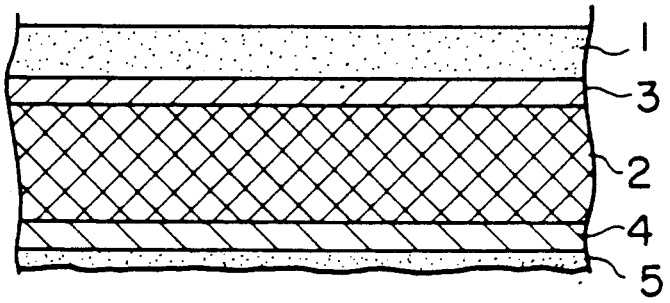
FIG. 1 is a cross-sectional view of one embodiment of a master according to the present invention.

The master of the present invention comprises a photoconductive layer 1, a paper 2 for a base, an α-polyolefin laminated layer 3 (hereinafter referred to as "undercoated layer") coating the photoconductive layer side of the paper 2, an α-polyolefin laminated layer 4 (hereinafter referred to as "back layer") coating the non-photoconductive layer side of the paper 2 and an over back layer 5 provided on the surface of the back layer 4, as shown in FIG. 1.

Each of the undercoated layer 3, paper 2 and back layer 4 has a volume resistivity of at most $10^{10}\Omega$and the over back layer 5 has a surface resistivity of at most $10^{10}\Omega$, whereby the following effects or performances are give. The paper base may have a volume resistivity of more than $10^{10}\Omega$.

(i) During exposure after statically charging, negative charges on exposed areas of the photoconductive layer rapidly pass through the substrate 2 to 5 and then neutralize positive charges on the surface of the over back layer 5.

(ii) Since the electric conductivity of the over back layer 5 is considerably high as described above, positive charges on the over back layer 5 are rapidly and correctly neutralized during development, resulting in uniform and correct formation of a so-called solid part.

(iii) According to the developing method by the direct electron injection system of the present invention, in particular, electrons directly fed from a conductor rapidly flow in the over back layer 5 having a considerably high electric conductivity and the neutralization of positive charges of the over back layer 5 can correctly be carried out at a high speed.

The over back layer 5 has a larger friction coefficient than the undercoated layer 3 and back layer 4, preferably a friction coefficient of at least 0.5, whereby the following effects or performances are given:

(iv) When the master, as a lithographic printing plate, is wound and fixed round a drum of a printing machine, the friction between the drum and over back layer becomes larger and the winding and fixing to a predetermined position can correctly and readily be carried out.

(v) The printing plate wound and fixed round the drum does not undergo slide during printing due to the above described larger friction, so even in the case of a solid part, a number of prints can correctly and finely be finished.

(vi) The master travelling through zones of static charge, exposure and development in an electrophotographic printing plate making machine does not suffer a slide from predetermined positions because of larger frictions between the over back layer 5 and constructing materials of these processing zones.

In the present invention, the α-polyolefins used for the above described undercoated layer 3 and back layer 4 typically include polyethylene, polypropylene and ethylene-butene copolymers and above all, polyethylene is preferably used.

As this polyethylene, there can preferably be used those having a density of 0.92 to 0.96 g/cc, melt index of 1.0 to 30 g/10 min, average molecular weight of 20,000 to 50,000, softening point of 110 to 130° C. and tensile strength of 130 to 300 kg/cm$^2$. More preferably, a composition is used comprising 10 to 90% by weight of low density polyethylene having a density of 0.915 to 0.930 g/cc and a melt index of 1.0 to 30 g/10 min and 90 to 10% by weight of high density polyethylene having a density of 0.940 to 0.970 g/cc and a melt index of 1.0 to 30 g/10 min.

This composition is capable of providing a normal and homogeneous heat resisting laminated layer, in which an electron conductive material hereinafter described can be dispersed in such a manner that electric current readily flows.

In the α-polyolefin laminated layer described above is contained an electron conductive material in such a manner that each of the paper 2, undercoated layer 3 and back layer 4 finally has a volume resistivity of at most $10^{10}\Omega$, preferably at most $10^{8}\Omega$, more preferably at most $10^{6}\Omega$. Examples of the electron conductive material are metal oxides of zinc, magnesium, tin, barium, indium, molybdenum, aluminum, titanium, silicon and the like, preferably fine particles of crystalline oxides or mixed oxides thereof, and carbon blacks (French Patent No. 2,277,136 and U.S. Pat. No. 3,597,272). Above all, electrically conductive carbon blacks are preferably used because of giving electric conductivity with a small amount and being compatible with polyethylene.

The quantity of the electron conductive material to be used, depending on the kinds of a paper base, α-polyolefin and electron conductive material, cannot unconditionally be determined, but should preferably be adjusted so as to give the above described volume resistance. Generally, the electron conductive material is used in a proportion of about 5 to 30% by weight to the α-polyolefin.

The thickness of the undercoated layer 3 or back layer 4 consisting of the α-polyolefin lamination is generally in the range of 5 to 50 μm, preferably 10 to 30 μm, since if too thin, the waterproofness is insufficient, while if too thick, its effect is not increased for the thickness.

For the purpose of improving the bonding strength between the α-polyolefin lamination layer 3 or 4 and the paper 2, it is preferable to coat the paper 2 with a polyethylene derivative such as ethylene-vinyl acetate copolymer, ethylene-acrylic acid ester copolymer, ethylene-methacrylic acid ester copolymer, ethylene-acrylic acid ester, ethylene-methacrylic acid copolymer, ethylene-acrylonitrile-acrylic acid copolymer or ethylene-acrylonitrile-methacrylic acid copolymer, or to subject the surface of the paper 2 to a corona discharge treatment. Furthermore, the paper 2 can also be subjected to various surface treatments such as described in Japanese Pat. Laid-Open Publication Nos. 24126/1974, 36176/1977, 121683/1977, 2612/1978, 111331/1979 and Japanese Pat. Publication No. 25337/1976.

In the present invention, the over back layer 5 provided on the above described back layer 4 contains the above described electron conductive material and particles for controlling the friction resistance (particle diameter 100 Åto 5 μm) uniformly dispersed in a binder consisting of a polymer.

For example, the polymer for this binder includes polystyrene, polybutadiene, polyacrylates, polymethacrylates, polyamylose acetate, nylon, poly-carbonates, polyvinyl formate, polyvinyl acetate, poly-acenaphthylene, polyisoprene, polyethylene, polyethylene terephthalate, polyvinyl chloride, polyoxyethylene, polypropylene oxide, polytetrahydrofuran, polyvinyl alcohol, polyphenylene oxide, polypropylene and copolymers thereof. These polymers are particularly suitable for obtaining the over back layer 5 having a predetermined friction resistance.

As an electron conductive material dispersed in the matrix of the overback layer 5, there can be used those similar to used in the above described undercoated layer 3 and back layer 4 in such an amount that the surface resistivity of the over back layer 5 be finally at most $10^{10}\Omega$, preferably at most $10^{8}\Omega$, more preferably at most $10^{6}\Omega$. The amount of the electron conductive material, depending on the kinds of the polymer and particles with the above described particle diameter, cannot unconditionally be determined, but it is generally in the range of 8 to 15% by weight to the polymer of the binder.

As the above described particles for controlling the friction resistance, dispersed in the binder together with the electron conductive material, there can be used oxides and sulfides of metals such as aluminum, silicon, zinc, titanium, molybdenum, tungsten, iron, lead, cobalt, nickel, copper and the like, colloidal alumina, colloidal silica, clay and the like.

The amount of the particles, depending on the particle size thereof, cannot unconditionally be determined, but it is so chosen that a predetermined friction resistance can be obtained, that is, in general, substantially the same as the weight of the polymer of the binder.

The over back layer 5 consisting of the above described materials can be provided by coating uniformly the whole surface of the back layer 4 with a dispersed coating composition of the above described materials to form a continuous layer and drying it to give a dry coverage of 1 to 30 g/m$^2$, preferably 3 to 30 g/m$^2$, or by coating intermittently the back layer 4 on several sites in suitable manner and drying to give a dry coverage of 2 to 40 g/m$^2$, preferably 4 to 40 g/m$^2$. If the coating amount is less than the lower limit, the above described friction resistance cannot be obtained, while if more than the upper limit, the friction resistance is excessive and various troubles occur as in the case of excessively coarsening the surface.

In order to increase the bonding strength between the over back layer and back layer 4, any suitable procedure can be employed, for example, by subjecting the surface of the back layer 4 to corona discharge treatment, by coarsening the surface of the back layer 4 or by irradiating the surface of the back layer 4 with ions.

In the present invention, as the paper 2, there are used electrically conductive paper bases commonly used for electrophotographic light-sensitive materials, for example, papers impregnated with the above described electron conductive materials, papers to which the electron conductive materials have been added during paper making and synthetic papers described in Japanese Pat. Publication Nos. 4239/1977, 19031/1978 and 19684/1978. Above all, it is desirable to use those having a basis weight of 50–250 g/m$^2$, preferably 50–200 g/m$^2$and thickness of 50 to 200 μm.

In the present invention, the photoconductive layer 1 comprises a photoconductive material and a binder. Examples of the photoconductive material are inorganic photoconductive materials such as zinc oxide, cadmium sulfide and titanium oxide. Examples of the binder are silicone resins, polystyrene, polyacrylates, polymethacrylates, polyvinyl acetate, polyvinyl chloride, polyvinyl butyral and derivatives thereof. The ratio of the photoconductive material and binder is preferably in the range of 3:1 to 20:1 by weight. If necessary, sensitizers and coating aids used for coating can be added. The photoconductive layer 1 has a thickness of preferably 5 to 30 μm.

For the purpose of improving the bonding strength between the photoconductive layer 1 and undercoated layer 3, it is preferable to previously subject the surface of the undercoated layer 3 to surface treatments such as corona discharge treatment, glow discharge treatment, flame treatments, ultraviolet ray treatment, ozone treatment, plasma treatment and the like, as disclosed in U.S. Pat. No. 3,411,908.

The master of the present invention, as illustrated above, is converted into a lithographic printing plate through the ordinary steps of statically charging, imagewise exposing and developing. During the same time, the development can be carried out by not only the liquid developing method of the prior art as shown in FIG. 3, but also the developing method of the present invention, based on the principle of the liquid developing method of direct feed system as shown in FIG. 2, the inventors have previously proposed in the prior patent application.

Figure 2:
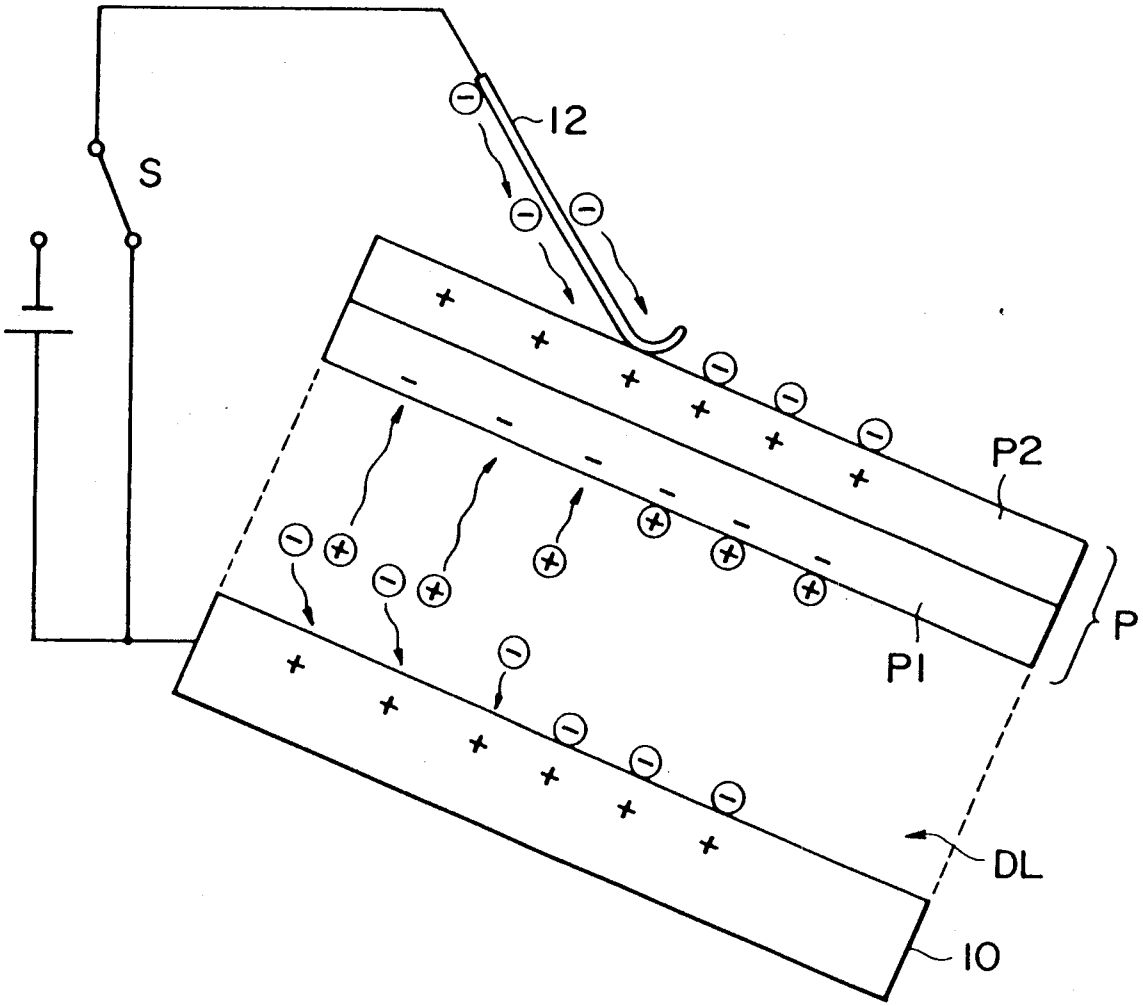
FIG. 2 is a schematic view to show the principle of a liquid development by direct electron injection system according to the present invention.
Figure 3:
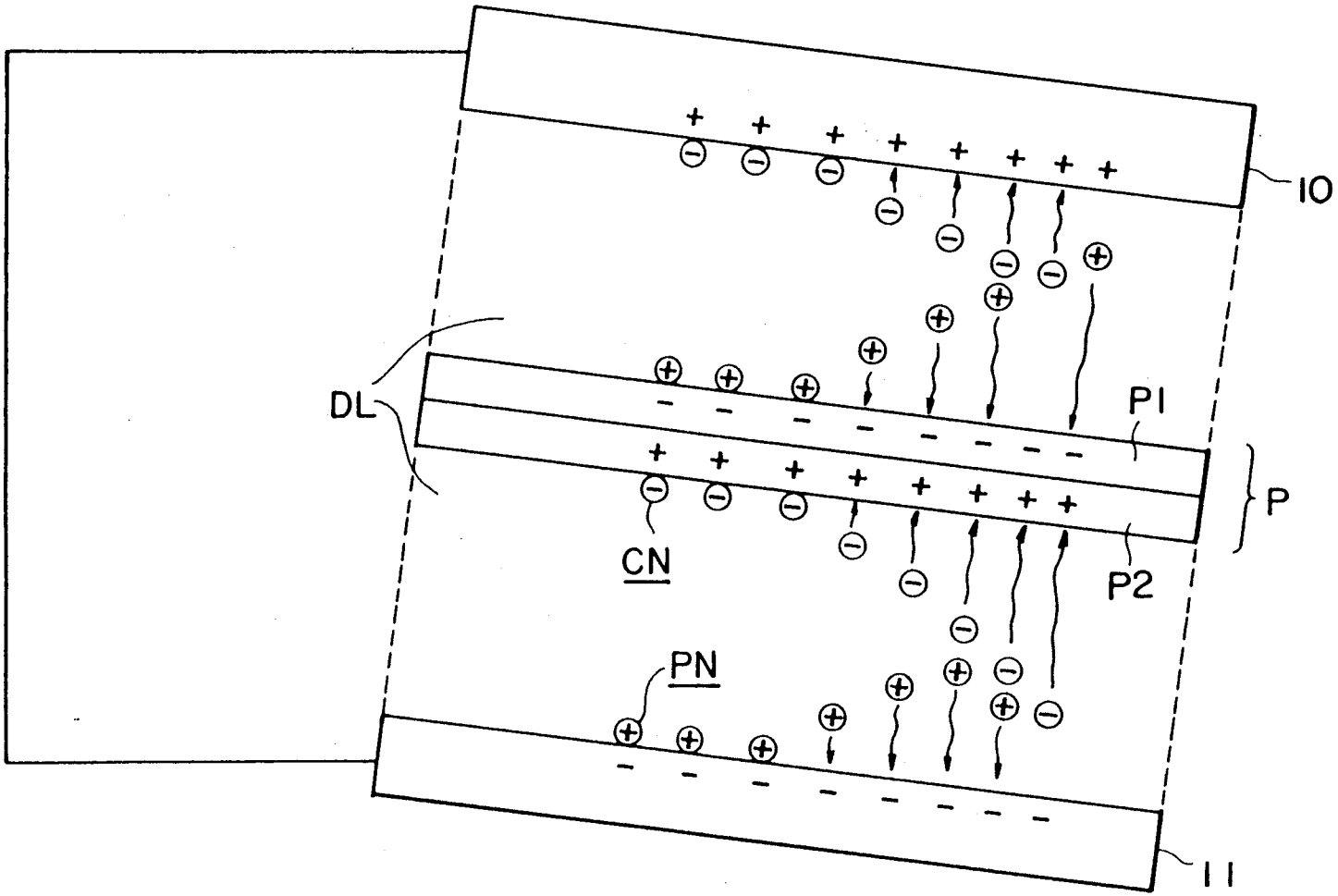
FIG. 3 is a schematic view to show the principle of a liquid development of the prior art.

In the developing method of the present invention, the conductor 12 of FIG. 2 is brought into contact with the above described over back layer 5 and the photoconductive layer 1 is allowed to face the electrode 10 of FIG. 2, or a switch S is changed and a voltage is applied to between the electrode 10 and conductor 12 so that the electrode 10 becomes a positive electrode and the conductor 12 becomes a negative electrode. If necessary, the over back layer 5 is electrically grounded through the conductor 12.

The positive charges on the surface of the over back layer 5, which have not been neutralized and remained in the step of imagewise exposing, are thus neutralized rapidly with electrons directly fed from the conductor 12 or earth, so that toners (+) rapidly adhere to the photoconductive layer 1 (−) and is neutralized.

These performances can be displayed in both the cases where the over back layer 5 is fully and uniformly coated, as a continuous layer, on the back layer and where it is intermittently coated on several suitable sites thereof. Thus, a uniform solid part can be formed without formation of toner-non-adhered areas.

It will clearly be understood from the foregoing detailed illustration that according to the present invention, the friction coefficient of the surface of a substrate can be increased while maintaining lowered the electric resistance of the substrate. Thus, operation of winding and fixing the resulting printing plate round a drum of a printing machine can readily be carried out and it is correctly wound and fixed to a predetermined position. In addition, the printing plate does not suffer any slide during printing, thus resulting in a number of correct and fine prints. Furthermore, even in an electrophotographic plate making machine, a master can readily and correctly be wound round a paper feeding drum, fed from the drum and travelled through the predetermined zones of statically charging, exposing and developing, thus resulting in an excellent electrophotographic printing plate.

Since in the present invention, development is carried out by directly injecting electrons to the over back layer, neutralization of charges on the layer can rapidly and correctly be carried out and consequently, adhesion of toners to the photoconductive layer can well be forwarded, thus rendering it possible to form a uniform solid image.

According to the present invention, therefore, an electrophotographic lithographic printing plate precursor or master can be obtained with excellent properties.

The present invention will now be illustrated in greater detail by way of examples, but it should be understood that the present invention is not limited thereto. In these examples, parts and percents are to be taken as those by weight unless otherwise indicated.

EXAMPLE 1

A fine quality paper with a basis weight of 100 g/m$^2$ was coated with a 5% aqueous solution of calcium chloride to give an amount of 20 g/m$^2$ and dried to obtain an electrically conductive base paper 2 as shown in FIG. 1.

Both the surfaces of the paper were coated with an aqueous latex of ethylene-methyl acrylate-acrylic acid copolymer (mole ratio =65:30:5) to give a dry coverage of 0.2 g/m$^2$, dried and then laminated respectively in a thickness of 25 μm by an extrusion method using pellets obtained by melting and kneading a composition comprising 70% of low density polyethylene having a density of 0.920 g/cc and melt index of 5.0 g/10 min, 15% of high density polyethylene having a density of 0.950 g/cc and melt index of 8.0 g/10 min and 15% of electrically conductive carbon, thus forming the undercoated layer 3 and back layer 4, each consisting of a uniform thickness polyethylene layer as shown in FIG. 1.

The resulting substrate consisting of the paper 2, undercoated layer 3 and back layer 4 had a volume electric resistivity of $1\times10^8\Omega$.

The surface of the under coated layer 3 was subjected to a corona :discharge treatment under 5 KVA.sec/m$^2$, then coated with a dispersed coating composition having the following recipe to give a dry coverage of 20 g/m$^2$ and dried, thus providing the photoconductive layer 1 as shown in FIG. 1.

| Recipe | Parts |
|---|---|
| Photconductive Zinc Oxide (Sazex 2000 -commercial name- made by Sakai Kagaku Kogyo KK) | 100 |
| Silicone Resin (KR-211 -commercial name- made by Shinetsu Kagaku KK) | 35 |
| Rose Bengal | 0.1 |
| Fluorescein | 0.2 |
| Methanol | 10 |
| Toluene | 150 |

Further, the surface of the back layer 4 was subjected to a corona discharge treatment under 5 KVA.sec/m$^2$, then coated fully and continuously with a dispersed coating composition having the following recipe to give a dry coverage of 10 g/m$^2$ and dried to provide the over back layer 5 as shown in FIG. 1.

| Recipe | Parts |
|---|---|
| Styrene-Butadiene Latex (solid content 50%) | 100 |
| Carbon Black | 0–15 |
| Clay (aqueous dispersion: solid content 45%, particle diameter: 0.4 μm) | 100 |

-continued

| Recipe | Parts |
|---|---|
| Water | 55 |

The surface resistivity and friction coefficient of the resulting over back layer are shown in Table 1.

The thus obtained samples of electrophotographic lithographic printing plate precursor or master were subjected to statically charging, imagewise exposing and then liquid developing by the direct electron injection system using a test device based on the principle of FIG. 2, in which the conductor 12 of hardened steel with a diameter of 0.1 mm was contacted with the over back layer 5 and the switch S being changed, the conductor 12 and electrode 10 were directly combined without using an external power source.

As an exposure image, there was used a copy pasted, at the center thereof, with a black sheet of 182 mm ×257 mm (B5 size) so as to examine the uniformity of a solid part as one object of the present invention. A series of the resulting lithographic printing plate samples were then subjected to examination of the reflection density (i.e. uniformity of solid part) and the slide of the printing plate during printing, thus resulting in data shown in Table 1.

The slide during printing was examined after printing 3000 sheets under standard printing conditions using an offset printing machine, Hamada 800 SX (commercial name). During the same time, the number of prints were examined when the solid area was not inked.

TABLE 1

| Sample No. | Over Back Layer 5: Amount of Carbon Added (parts) | Surface Electric Resistivity*(1) (Ω) | Friction Coefficient*(2) (tanθ) | Reflection Density of Toner*(3) | Slide of Printing Plate*(4) (mm) | Printing Durability (number) |
|---|---|---|---|---|---|---|
| 1 | no over back layer | $7.0 \times 10^8$ | 0.5 | 1.17 | >6 | >3000 |
| 2 | 0 | $1.1 \times 10^{12}$ | 0.96 | 0.71 | 0 | 100 |
| 3 | 2 | $8.5 \times 10^{11}$ | 0.96 | 0.75 | 0 | 400 |
| 4 | 4.5 | $1.3 \times 10^{11}$ | 0.95 | 0.84 | 0 | 1200 |
| 5 | 7 | $3.5 \times 10^{10}$ | 0.89 | 0.88 | 0 | 1800 |
| 6 | 8 | $9.4 \times 10^9$ | 0.86 | 0.96 | 0 | >3000 |
| 7 | 8.5 | $5.7 \times 10^9$ | 0.83 | 1.02 | 0 | >3000 |
| 8 | 9 | $2.2 \times 10^9$ | 0.79 | 1.10 | 0 | >3000 |
| 9 | 9.5 | $7.7 \times 10^8$ | 0.77 | 1.16 | 0 | >3000 |
| 10 | 10 | $1.9 \times 10^8$ | 0.74 | 1.12 | 0 | >3000 |
| 11 | 10.5 | $4.1 \times 10^7$ | 0.71 | 1.24 | 0 | >3000 |
| 12 | 12 | $2.1 \times 10^7$ | 0.70 | 1.24 | 1.2 | >3000 |

Note:
*(1)measured by joint use of Universal Electrometer MMAI-17 (commercial name, manufactured by Kawaguchi Denki KK) and Measuring Chamber P-601 (commercial name).
*(2)measured by JIS P 8111 (fixed test piece: test sample) (slipping test piece: polished stainless steel surface).
*(3)by Macbeth Reflection Densitometer
*(4)slide of image from a print at start after printing the number of prints corresponding to the printing durability as shown in Table 1 under the standard conditions using an offset printing machine, Hamada 800 SX.

For the purpose of maintaining sufficient the printing durability corresponding to the adhesion quantity of toners by the direct electron injection system, it is required that the solid reflection density is at least 0.9 and the surface electric resistivity of the over back layer 5 is at most $1 \times 10^{10}\Omega$. Therefore, Sample Nos. 6 to 11 in Table 1 are suitable.

As is evident from Table 1, the friction coefficient of the over back layer 5 should be at least 0.71 (friction coefficient of back layer: 0.5) so as to prevent slide, and Sample Nos. 6 to 11 each having a friction coefficient of at least 0.71 and a toner reflection density of at least 0.96 exhibit a printing durability of at least 3000 sheets and is extremely improved in plate slide.

EXAMPLE 2

Example 1 was repeated except using aluminum fine powder with a mean particle diameter ob 1.5 μm in a proportion of 0 to 25 parts in place of a carbon black of the over back layer 5 and the clay in a proportion of 100 parts, thus obtaining results as shown in Table 2.

TABLE 2

| Sample No. | Over Back Layer 5: Amount of Aluminum Fine Powder Added (parts) | Surface Electric Resistivity (Ω) | Friction Coefficient (tanθ) | Reflection Density of Toner | Slide of Printing Plate (mm) | Printing Durability (number) |
|---|---|---|---|---|---|---|
| 1 | no over back layer | $7.0 \times 10^9$ | 0.5 | 1.17 | >6 | >3000 |
| 21 | 2 | $1.3 \times 10^{12}$ | 0.96 | 0.70 | 0 | 150 |
| 22 | 5 | $5.4 \times 10^{11}$ | 0.93 | 0.78 | 0 | 600 |
| 23 | 10 | $4.1 \times 10^{10}$ | 0.86 | 0.86 | 0 | >3000 |
| 24 | 15 | $2.7 \times 10^7$ | 0.72 | 1.24 | 0 | >3000 |
| 25 | 20 | $4.5 \times 10^4$ | 0.66 | 1.25 | 1.5 | >3000 |
| 26 | 25 | $8.3 \times 10^3$ | 0.61 | 1.26 | 5 | >3000 |

EXAMPLE 3

Example 1 was repeated except changing the amount of clay added to the over back layer 5, thus obtaining results as shown in Table 3.

TABLE 3

| Sample No. | Over Back Layer 5: Amount of Clay (45%) Added (parts) | Surface Electric Resistivity (Ω) | Friction Coefficient (tanθ) | Reflection Density of Toner | Slide of Printing Plate (mm) | Printing Durability (number) |
|---|---|---|---|---|---|---|
| 1 | no over back layer | $7.0 \times 10^9$ | 0.5 | 1.17 | >6 | >3000 |
| 13 | 55 | $4.8 \times 10^9$ | 0.98 | 1.01 | 0 | >3000 |
| 14 | 71 | $5.9 \times 10^9$ | 0.93 | 1.00 | 0 | >3000 |
| 15 | 86 | $7.7 \times 10^9$ | 0.90 | 0.98 | 0 | >3000 |
| 16 | 100 | $9.4 \times 10^9$ | 0.86 | 0.96 | 0 | >3000 |
| 17 | 135 | $9.9 \times 10^9$ | 0.72 | 0.95 | 0.5 | >3000 |

As is evident from Table 3, the amount of clay largely affects the friction coefficient, but does not affect largely the other properties. The amounts shown in Table 3 give good results.

EXAMPLE 4

Example 1 was repeated except changing the binder of the over back layer 5 and using the amounts of the binder, carbon black, clay and water described below:

| | |
|---|---|
| Binder (solid content: 50%) | 100 |
| Carbon Black | 10 |
| Clay (aqueous dispersion: 45%; particle diameter: 0.4 μm) | 100 |
| Water | 55 |

TABLE 4

| Sample No. | Over Back Layer 5: Binder (50%) | Surface Electric Resistivity (Ω) | Friction Coefficient (tanθ) | Reflection Density of Toner | Slide of Printing Plate (mm) | Printing Durability (number) |
|---|---|---|---|---|---|---|
| 1 | no over back layer | $7.0 \times 10^9$ | 0.5 | 1.17 | >6 | >3000 |
| 18 | SBR | $1.9 \times 10^8$ | 0.74 | 1.22 | 0 | >3000 |
| 19 | (*) | $5.4 \times 10^9$ | 0.68 | 1.15 | 0 | >3000 |
| 20 | (**) | $2.2 \times 10^9$ | 0.73 | 1.21 | 0 | >3000 |

Note:
(*) vinyl chloride-vinyl acetate-ethylene copolymer
(**) polyacrylate

As is evident from Table 4, the friction coefficient is largely affected, but Sample Nos. 18 to 20 all give better results than Sample No. 1 having no over back layer 5.

What is claimed is:

1. An electrophotographic lithographic printing plate precursor comprising a base of paper coated, on both surfaces thereof, with α-polyolefin laminated layers each having a volume resistivity of at most $1 \times 10^{10}\Omega$and being provided, on one side thereof, with a photoconductive layer and on the other side thereof, with an over back layer having a surface resistivity of at most $1 \times 10^{10}$106 and a larger friction coefficient than the α-polyolefin laminated layer.

2. The electrophotographic lithographic printing plate precursor as claimed in claim 1, wherein the over back layer has a friction coefficient of at least 0.5.

3. The electrophotographic lithographic printing plate precursor as claimed in claim 1, wherein the α-polyolefin is selected from the group consisting of polyethylene, polypropylene and ethylene-butene copolymers.

4. The electrophotographic lithographic printing plate precursor as claimed in claim 3, wherein the polyethylene is one having a density of 0.9 to 0.96, a melt index of 1 to 30 g/10 min, an average molecular weight of 20,000 to 50,000, a softening point of 110 to 130° C. and a tensile strength of 130 to 300 kg/cm$^2$.

5. The electrophotographic lithographic printing plate precursor as claimed in claim 3, wherein the polyethylene is used in the form of a mixture of 10 to 90% by weight of a low density of polyethylene having a density of 0.915 to 0.930 and a melt index of 1 to 30 g/10 min and 90 and 10% by weight of a high density polyethylene having a density of 0.940 to 0.970 and a melt index of 1 to 30 g/10 min.

6. The electrophotographic lithographic printing plate precursor as claimed in claim 1, wherein the α-polyolefin laminated layer contains an electron conductive material to give the laminated layer a volume resistivity of at most $1 \times 10^{10}\Omega$.

7. The electrophotographic printing plate precursor as claimed in claim 6, wherein the electron conductive material is selected from the group consisting of metal oxide fine particles of zinc, magnesium, tin, barium, indium, molybdenum, aluminum, titanium and silicon, fine particles of crystalline metal oxides and mixed metal oxides thereof and carbon blacks.

8. The electrophotographic lithographic printing plate precursor as claimed in claim 6, wherein the electron conductive material is contained in a proportion of 5 to 30% based on the α-polyolefin.

9. The electrophotographic lithographic printing plate precursor as claimed in claim 1, wherein the α-polyolefin laminated layer has a thickness of 5 to 50 μm.

10. The electrophotographic lithographic printing plate precursor as claimed in claim 1, wherein the paper is subjected to a pretreatmene before the lamination of the α-polyolefin.

11. The electrophotographic lithographic printing plate precursor as claimed in claim 10, wherein the pretreatment is a corona discharge treatment.

12. The electrophotographic lithographic printing plate precursor as claimed in claim 10, wherein the pretreatment is carried out by coating a polyethylene derivative selected from the group consisting of ethylene-vinyl acetate copolymers, ethylene, acrylic acid ester copolymers, ethylene-methacrylic acid ester copolymers, ethylene-acrylic acid copolymers, ethylene-methacrylic acid copolymers, ethylene-acrylonitrile-acrylic acid copolymers and ethylene-acrylonitrile-methacrylic acid copolymers.

13. The electrophotographic lithographic printing plate precursor as claimed in claim 1, wherein the over back layer consists of a binder, electron conductive material and friction resistance controlling material.

14. The electrophotographic lithographic printing plate precursor as claimed in claim 13, wherein the binder is selected from the group consisting of polystyrene, polybutadiene, polyacrylates, polymethacrylates, polyamylose acetate, nylon, polycarbonates, polyvinyl formate, polyvinyl acetate, polyacenaphthylene, polyisoprene, polyethylene, polyethylene terephthalate, polyvinyl chloride, polyoxyethylene, polypropylene oxide, polytetra-hydrofuran, polyvinyl alcohol, polyphenylene oxide, polypropylene and copolymers thereof.

15. The electrophotographic lithographic printing plate precursor as claimed in claim 13, wherein the electron conductive material is one as claimed in 7.

16. The electrophotographic lithographic printing plate precursor as claimed in claim 13, wherein the electron conductive material is contained to give the over back layer the surface resistance of at most $10^{10}\Omega$.

17. The electrophotographic lithographic printing plate precursor as claimed in claim 16, wherein the electron conductive material is in a proportion of 8 to 15% by weight based on the binder.

18. The electrophotographic lithographic printing plate precursor as claimed in claim 13, wherein the friction resistance controlling material is selected from the group consisting of oxides and sulfides of aluminum, silicon, zinc, titanium, molybdenum, tungsten, iron, lead, cobalt, nickel and copper, colloidal alumina, colloidal silica and clay.

19. The electrophotographic lithographic printing plate precursor as claimed in claim 1, wherein the over back layer is a uniformly and continuously coated layer with a dry coverage of 1 to $+g/m^2$.

20. The electrophotographic lithographic printing plate precursor as claimed in claim 1, wherein the over back layer is an intermittently coated layer with a dry coverage of 2 to 40 $g/m^2$.

21. The electrophotographic lithographic printing plate precursor as claimed in claim 1, wherein the paper is an electrically conductive base paper.

22. The electrophotographic lithographic printing plate precursor as claimed in claim 1, wherein the photoconductive layer consists of a binder and photoconductive material.

23. The electrophotographic lithographic printing plate precursor as claimed in claim 22, wherein the binder is selected from the group consisting of silicone resins, polystyrene, polyacrylic acid esters, polymethacrylic acid esters, polyvinyl acetate, polyvinyl chloride, polyvinyl butyral and derivatives thereof.

24. The electrophotographic lithographic printing plate precursor as claimed in claim 22, wherein the photoconductive material is an inorganic photoconductive material selected from the group consisting of zinc oxide, cadmium sulfide and titanium oxide.

25. The electrophotographic lithographic printing plate precursor as claimed in claim 22, wherein the binder and photoconductive material are in a proportion of 3:1 to 20:1 by weight.

26. The electrophotographic lithographic printing plate precursor as claimed in claim 1, wherein the photoconductive layer has a thickness of 5 to 30 $\mu$m.

* * * * *